US008880302B1

(12) United States Patent
Tachibana et al.

(10) Patent No.: US 8,880,302 B1
(45) Date of Patent: Nov. 4, 2014

(54) WORKING VEHICLE AND METHOD FOR CONTROLLING THE WORKING VEHICLE

(71) Applicant: Komatsu Ltd., Tokyo (JP)

(72) Inventors: Tatsuhiko Tachibana, Komatsu (JP); Manabu Himoto, Kyotanabe (JP); Daisuke Tsumura, Hirakata (JP)

(73) Assignee: Komatsu Ltd., Tokyo (JP)

( * ) Notice: Subject to any disclaimer, the term of this patent is extended or adjusted under 35 U.S.C. 154(b) by 0 days.

(21) Appl. No.: 14/127,710

(22) PCT Filed: Jul. 26, 2013

(86) PCT No.: PCT/JP2013/070365

§ 371 (c)(1),
(2), (4) Date: Dec. 19, 2013

(51) Int. Cl.

| | |
|---|---|
| ***E02F 9/22*** | (2006.01) |
| ***E02F 9/24*** | (2006.01) |
| ***F15B 11/10*** | (2006.01) |
| ***E02F 3/42*** | (2006.01) |
| ***F15B 21/02*** | (2006.01) |
| ***E02F 9/26*** | (2006.01) |
| ***F15B 20/00*** | (2006.01) |

(52) U.S. Cl.
CPC ... *E02F 9/22* (2013.01); *E02F 9/24* (2013.01); *F15B 11/10* (2013.01); *E02F 3/425* (2013.01); *F15B 2211/6355* (2013.01); *F15B 21/02* (2013.01); *E02F 9/26* (2013.01); *F15B 20/00* (2013.01); *F15B 2211/665* (2013.01)
USPC ..... 701/50; 701/36; 60/459

(58) Field of Classification Search
CPC ..... E02F 9/22; E02F 3/425; E02F 9/24; E02F 9/26; E02F 9/2285; E02F 9/2296; E02F 9/226; E02F 9/265; F15B 2211/665; F15B 2211/6355; F15B 2211/329; F15B 21/02; F15B 20/00
USPC ..... 701/36, 50; 60/459
See application file for complete search history.

(56) References Cited

U.S. PATENT DOCUMENTS

| | | | | |
|---|---|---|---|---|
| 5,632,190 | A * | 5/1997 | Sunamura et al. | 91/459 |
| 8,098,128 | B2 * | 1/2012 | Arakawa | 340/5.2 |

FOREIGN PATENT DOCUMENTS

| | | | |
|---|---|---|---|
| JP | 11-21079 | A | 1/1999 |
| JP | 2005-264605 | A | 9/2005 |
| JP | 2013-147149 | A | 8/2013 |

OTHER PUBLICATIONS

International Search Report for PCT/JP2013/070365, issued on Oct. 15, 2013.

* cited by examiner

*Primary Examiner* — Richard Camby
(74) *Attorney, Agent, or Firm* — Global IP Counselors, LLP

(57) ABSTRACT

A lock valve is switched from lock condition to release condition when a lock member is switched from lock position to release position. When pilot pressure is at least a predetermined pressure when the elapsed time from the point at which the lock member is switched from lock position to release position is at least a first predetermined time, the lock valve is maintained in the release condition. When pilot pressure is at least the predetermined pressure, the continuous time duration is greater than the second predetermined time when the elapsed time is less than the first predetermined time, the lock valve is switched to the lock condition. When pilot pressure is at least the predetermined pressure, the continuous time duration is no more than the second predetermined time when the elapsed time is less than the first predetermined time, the lock valve is allowed to be switched.

13 Claims, 8 Drawing Sheets

WORKING VEHICLE AND METHOD FOR CONTROLLING THE WORKING VEHICLE

CROSS-REFERENCE TO RELATED APPLICATIONS

This application is a U.S. National stage application of International Application No. PCT/JP2013/070365, filed on Jul. 26, 2013.

BACKGROUND

1. Field of the Invention

The present invention relates to a working vehicle and a method for controlling the working vehicle.

2. Background Information

A working vehicle is provided with a hydraulic actuator and an operating member for operating the hydraulic actuator. An operator operates the hydraulic actuator using the operating member. Further, the working vehicle may be provided with a lock member for locking operation of the hydraulic actuator by the operating member. For example, the working vehicle disclosed in Japan Patent Laid-open Patent Publication JP-A-11-21079 is provided with a lock lever capable of switching between a lock position and a release position. When the lock lever is operated to be in the lock position, operation of the hydraulic actuator is locked. In this way, even if an operator operates an operating lever, the hydraulic actuator will not move. When the lock lever is operated to be in the release position, the lock on the hydraulic actuator is released.

In a working vehicle provided with a lock member as described above, with the operating member in the condition of being shifted to the position for operating the hydraulic actuator (hereinafter referred to as the "actuator drive position"), when the lock member is switched to the release position, there is a possibility that the hydraulic actuator will move unexpectedly. In order to prevent this kind of movement by the hydraulic actuator, when the lock member has switched to the release position, it is effective to detect that the operating member is positioned in the actuator drive position.

In Japan Patent Laid-open Patent Publication JP-A-11-21079, the set pressure of a primary side pressure switch of an operating lever is set at a lower pressure than the set pressure of a secondary side pressure switch. Accordingly, when the lock lever is switched to the release position in a state where the operating lever is set in the actuator drive position, the primary side pressure switch comes ON prior to the secondary side pressure switch. That is to say, as the primary side pressure switch goes to ON prior to the secondary side pressure switch, the operating member is determined to be positioned in the actuator drive position.

SUMMARY

In the case of a determination made using a pressure switch as described above, however, it is not easy to obtain sufficient accuracy. An object of the present invention is to provide a working vehicle and a method for controlling a working vehicle that enable accurate determination of whether or not the operating member is operated to be in the actuator drive position when the lock member has been switched to the release position.

The working vehicle according to a first aspect of the present invention is provided with a hydraulic actuator, an operating member, a pilot valve, an actuator control valve, a lock member, an operation console, a lock valve, a lock valve switching unit, an elapsed time detection unit, a first time determination unit, a pilot pressure determination unit, a second time determination unit, and an error operation monitoring unit. The operating member is a member for operating the hydraulic actuator. The pilot valve outputs pilot pressure in conformance with operation of the operating member. The actuator control valve controls the hydraulic actuator in conformance with input pilot pressure. The lock member is capable of switching between a lock position and a release position. The operation console supports the operating member and the lock member. The operation console is provided so as to be movable together with the lock member. The lock valve can switch between a release condition and a lock condition. The lock valve in the release condition allows supply of pilot pressure to the actuator control valve. The lock valve in the lock condition shuts off supply of pilot pressure to the actuator control valve. The lock valve switching unit switches the lock valve from the lock condition to the release condition when the lock member switches from the lock position to the release position. The elapsed time detection unit detects the time that has elapsed from the point in time when the lock member switched from the lock position to the release position. The first time determination unit determines whether or not the elapsed time is greater than or equal to a first predetermined time. The pilot pressure determination unit determines whether or not the pilot pressure is greater than or equal to a predetermined pressure. The second time determination unit determines whether or not the continuous time duration during which the pilot pressure is greater than or equal to the predetermined pressure is less than or equal to a second predetermined time. The error operation monitoring unit allows switching over of the lock valve by the lock valve switching unit in a case that the pilot pressure becomes greater than or equal to the predetermined pressure when the elapsed time is greater than or equal to the first predetermined time. The error operation monitoring unit switches the lock valve to the lock condition in a case that the pilot pressure becomes greater than or equal to the predetermined pressure and the continuous time duration is greater than the second predetermined time when the elapsed time is less than the first predetermined time. The error operation monitoring unit allows switching over of the lock valve by the lock valve switching unit in a case that the pilot pressure becomes greater than or equal to the predetermined pressure, moreover the continuous time duration is less than or equal to the second predetermined time when the elapsed time is less than the first predetermined time.

In the working vehicle according to the first aspect of the present invention, when the lock member is switched from the lock position to the release position, the error operation monitoring unit switches the lock valve from the lock condition to the release condition. However, in the case that the pilot pressure is greater than or equal to the predetermined pressure and the continuous time duration is greater than the second predetermined time when the elapsed time is less than the first predetermined time, the error operation monitoring unit switches the lock valve to the lock condition. In this way, pilot pressure rapidly rising up means that in the condition in which the operating member is set to the actuator drive position, the lock member is switched to the release position. Accordingly, there can be an accurate determination of whether or not the operating member is set in the actuator drive position when the lock member is switched to the release position.

When the operator operates the lock member, the operation console moves together with the lock member. As the operation console supports the operating member, it is possible that the operating member may move due to shock from movement of the operation console. In this case, even though the operating member is not set to the actuator drive position, the pilot pressure momentarily increases. That is to say, even though the operating member has not been erroneously operated, the pilot pressure comes to rapidly rise up.

Thus, in the working vehicle according to this aspect, when the elapsed time is less than the first predetermined time, even though the pilot pressure becomes greater than or equal to the predetermined pressure, in the case that the continuous time duration is less than or equal to the second predetermined time, the error operation monitoring unit maintains the lock valve in the release condition. Accordingly, in the case that the increase in pilot pressure is nothing more than momentary, this is not seen as an error operation and the lock valve is maintained in the release condition. In this way, it can be accurately determined that the operating member is not set in the actuator drive position when the lock member has switched to the release position.

Further, in the case that the pilot pressure becomes greater than or equal to the predetermined pressure when the elapsed time is greater than or equal to the first predetermined time, the error operation monitoring unit maintains the lock valve in the release condition. In this way, the pilot pressure slowly rising means that the lock member has switched to the release position in the condition in which the operating member is not set in the actuator drive position. In this way, it can be accurately determined that the operating member is not set in the actuator drive position when the lock member has switched to the release position.

In preferred practice, the first predetermined time is the time until the pilot pressure rises up to the predetermined pressure when the lock member has switched from the lock position to the release position in a condition in which the operating member is set in the position for operating the hydraulic actuator. Here, the first predetermined time can be set by simulation or experimentation conducted in advance.

In preferred practice, the first predetermined time is greater than or equal to 0.2 seconds and less than or equal to 2 seconds. In this case, when the lock member has switched to the release position, it can be accurately determined whether or not the operating member has been operated to be in the actuator drive position.

In preferred practice, the second predetermined time is less than the first predetermined time. In this case, it can be accurately determined that an increase in pilot pressure is a momentary increase due to shock from the operation console.

In preferred practice, the second predetermined time is less than 0.2 seconds. In this case it can be accurately determined that an increase in pilot pressure is a momentary increase due to shock from the operation console.

In preferred practice, the working vehicle is further provided with a hydraulic pump for supplying hydraulic fluid to the pilot valve. The lock valve is positioned along an oil path connecting the hydraulic pump and the pilot valve. In this case, even when a plurality of pilot oil paths are connected to the pilot valve, a single lock valve is capable of shutting off pilot pressure output to a plurality of oil paths.

In preferred practice, the working vehicle is further provided with a controller, a pilot pressure detection unit, a lock valve switching unit, a first signal line, a second signal line, a third signal line, a relay, and a fourth signal line. The controller includes the elapsed time detection unit, the first time determination unit, the second time determination unit, and the error operation monitoring unit. The pilot pressure detection unit detects pilot pressure. The lock valve switching unit links to operation of the lock member. The first signal line conveys a signal from the lock valve switching unit to the lock valve. The second signal line conveys a signal from the lock valve switching unit to the controller. The third signal line conveys a signal from the pilot pressure detection unit to the controller. The relay is arranged along the first signal line. The fourth signal line conveys a signal from the controller to the relay.

In this case, in response to a signal conveyed via the first signal line, the lock valve switches between the release condition and the lock condition in conformance with operation of the lock member. The controller, in response to a signal conveyed via the second signal line, can detect which position between the lock position and the release position the lock member is in. The controller, in response to a signal conveyed via the third signal line can detect the pilot pressure. The controller, by sending a signal to the relay via the fourth signal line, can switch the lock valve to the lock condition regardless of the operation of the lock member.

In preferred practice, the pilot valve outputs a plurality of pilot pressures including a first pilot pressure and a second pilot pressure output from an oil path different to that of the first pilot pressure. The first pilot pressure is the pilot pressure described above. In a case that among the plurality of pilot pressures at least one of the pilot pressures is greater than or equal to the predetermined pressure, and the continuous time duration is greater than the second predetermined time when the elapsed time is less than the first predetermined time, the error operation monitoring unit switches the lock valve to the lock condition. In this case, when the lock member is switched to the release condition, unexpected operations of the hydraulic actuator can be more accurately suppressed.

In preferred practice, the working vehicle is further provided with a notification unit. The notification unit outputs a notification to the operator when the error operation monitoring unit switches the lock valve to the lock condition. In this case, the fact that the operating member has been erroneously operated when the lock member is switched to the release position can be recognized by the operator being notified from the notification unit.

In preferred practice, the working vehicle is further provided with a temperature detection unit for detecting the temperature of the hydraulic fluid. The first time determination unit increases the first predetermined time to the extent that the temperature of the hydraulic fluid decreases. In this case, it can be accurately determined whether or not the operating member is set in the actuator drive position when the lock member is switched to the release position.

In preferred practice, the operation console is arranged so that it can pivot upward-downward. Together with the lock member switching from the lock position to the release position, the operation console pivots from higher toward lower. Here, when the lock member reaches the release position, shock readily arises at the operation console, but this kind of case also, will not be seen as an error operation, enabling the lock valve to be maintained in the release condition.

In preferred practice, the working vehicle is a hydraulic shovel having a revolving body. The hydraulic actuator can be any of a revolving motor for revolving the revolving body, a travel hydraulic motor, a boom cylinder, an arm cylinder, or a bucket cylinder. In this case, the above described determinations can be performed using the pilot pressure from any of the revolving motor, the travel hydraulic motor, the boom cylinder, the arm cylinder or the bucket cylinder.

The control method according to the second aspect of the present invention is a method for controlling a working vehicle. The working vehicle is provided with a hydraulic actuator, an operating member, a pilot valve, an actuator control valve, a lock member, operation console, and a lock valve. The operating member is a member for operating the hydraulic actuator. The pilot valve outputs pilot pressure in conformance with operation of the operating member. The actuator control valve controls the hydraulic actuator in conformance with input pilot pressure. The lock member is capable of switching between a lock position and a release position. The operation console supports the operating member and the lock member and is provided so as to be movable together with the lock member. The lock valve can switch between a release condition and a lock condition. The lock valve in the release condition, allows supply of pilot pressure to the actuator control valve. The lock valve in the lock condition, shuts off flow of pilot pressure to the actuator control valve. The control method comprises the following steps. A first step is a step for switching the lock valve from the lock condition to the release condition when the lock member switches from the lock position to the release position. A second step is a step for detecting the elapsed time that elapses from the point in time when the lock member switches from the lock position to the release position, until the pilot pressure rises to a predetermined pressure. A third step is a step for determining whether or not the elapsed time is greater than or equal to a first predetermined time. A fourth step is a step for determining whether or not the continuous time duration at which the pilot pressure is greater than or equal to the predetermined pressure is less than or equal to a second predetermined time. A fifth step is a step for maintaining the lock valve in the release condition when the elapsed time is greater than or equal to the first predetermined time. A sixth step is a step for switching the lock valve to the lock condition when the elapsed time is less than the first predetermined time and the continuous time duration is greater than the second predetermined time. A seventh step is a step for maintaining the lock valve in the release condition when the elapsed time is less than the first predetermined time and the continuous time duration is less than or equal to the second predetermined time.

In the control method according to the second aspect of the present invention, when the lock member switches from the lock position to the release position, the lock valve switches from the lock condition to the release condition. However, when the elapsed time is less than the first predetermined time and the continuous time duration is greater than or equal to the second predetermined time, the lock valve switches to the lock condition. That the elapsed time is less than the first predetermined time means that the pilot pressure has rapidly risen up after the lock member has switched to the release position. Accordingly, it can be accurately determined whether or not the operating member is set in the actuator drive position when the lock member is switched to the release position.

However, in the case that the continuous time duration is less than or equal to the second predetermined time, even though the elapsed time is less than the first predetermined time, the lock valve is maintained in the release condition. Accordingly, in the case that the increase in pilot pressure is nothing more than momentary, this is not seen as an error operation and the lock valve is maintained in the release condition. In this way, it can be accurately determined that the operating member is not set in the actuator drive position when the lock member is switched to the release position.

Further, when the elapsed time is greater than or equal to the first predetermined time, the lock valve is maintained in the release condition. That the elapsed time is greater than or equal to the first predetermined time means that the pilot pressure has slowly risen up after the lock member has switched to the release position. Accordingly, it can be accurately determined that the operating member is not set in the actuator drive position when the lock member is switched to the release position.

In the control method according to the third aspect of the present invention, when the lock member, together with the operation console that supports the lock member and the operating member for operating the hydraulic actuator, switches from the lock position to the release position, the lock valve switches from the lock condition prohibiting operation of the hydraulic actuator to the release condition allowing operation of the hydraulic actuator. Then, in the case that the pilot pressure in conformance with operation of the operating member, rises up to the predetermined pressure within the first predetermined time from the point in time at which the lock member switches from the lock position to the release position, moreover, the pilot pressure is maintained greater than or equal to the predetermined pressure for a time longer than the second predetermined time, the lock valve switches to the lock condition. However, even though the pilot pressure rises up to the predetermined pressure within the first predetermined time from the point in time at which the lock member switches from the lock position to the release position, in the case that the continuous time duration for which the pilot pressure is maintained greater than or equal to the predetermined pressure is less than or equal to the second predetermined time, the lock valve is maintained in the release condition.

In the control method according to the third aspect of the present invention, when the lock member switches from the lock position to the release position, the lock valve switches from the lock condition to the release condition. However, in the case that, after the lock member has switched from the lock position to the release position, the pilot pressure rises up to the predetermined pressure within the first predetermined time, moreover is maintained at greater than or equal to the predetermined pressure for a time longer than the second predetermined time, the lock valve switches to the lock condition. That is to say, in the case that the pilot pressure rapidly rises up after the lock member switches to the release position, the lock valve switches to the lock condition. Accordingly, it can be accurately determined whether or not the operating member has been operated to be in the actuator drive position when the lock member has switched to the release position.

However, in the case that even though the pilot pressure rises up to the predetermined pressure within the first predetermined time, the continuous time duration is less than or equal to the second predetermined time, the lock valve is maintained in the release condition. Accordingly, in the case that the increase in pilot pressure is nothing more than momentary, this is not seen as an error operation, and the lock valve is maintained in the release condition. In this way, it can be accurately determined that the operating member is not set in the actuator drive position when the lock member has switched to the release position.

The working vehicle according to the present invention is capable of accurately determining whether or not the operating member is operated to be in the actuator drive position when the lock member is switched to the release position.

DETAILED DESCRIPTION OF EMBODIMENTS

Figure 1:
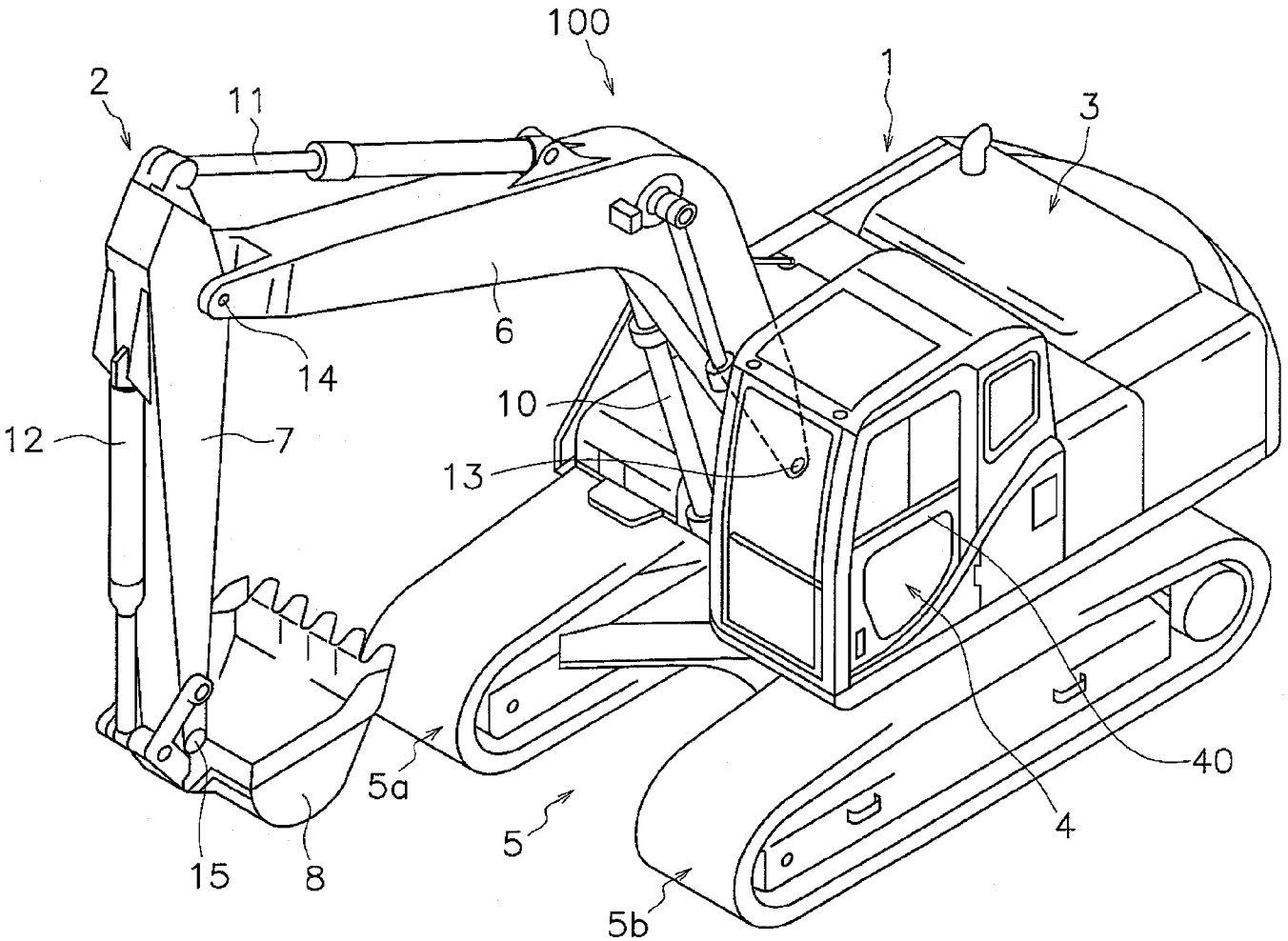
FIG. 1 is a perspective view of the working vehicle according to an embodiment of the present invention.

A working vehicle related to an embodiment of the present invention will now be described with reference to the drawings. FIG. 1 provides a perspective view of a working vehicle 100. The working vehicle 100 is a hydraulic shovel. The working vehicle 100 has a vehicle body 1 and a working instrument 2. The vehicle body 1 has a revolving body 3, a driver's cabin 4, and a traveling device 5. The driver's cabin 4 is arranged on the front part of the revolving body 3. Inside the driver's cabin 4 is arranged an operation device 25 described subsequently (refer FIG. 2). The traveling device 5 has crawler tracks 5*a* and 5*b*, and the working vehicle 100 is caused to travel by the rotation of the crawler tracks 5*a* and 5*b*.

The working instrument 2 is installed to the front part of the vehicle body 1, and has a boom 6, an arm 7, a bucket 8, a boom cylinder 10, an arm cylinder 11, and a bucket cylinder 12. The base end portion of the boom 6 is attached to the front part of the vehicle body 1 via a boom pin 13 so as to be capable of swinging. The base end portion of the arm 7 is attached to the leading end portion of the boom 6 via an arm pin 14 so as to be capable of swinging. At the leading end portion of the arm 7 the bucket 8 is attached via a bucket pin 15 so as to be capable of swinging. The boom cylinder 10, the arm cylinder 11, and the bucket cylinder 12 are driven by hydraulic fluid discharged from a hydraulic pump 22 described subsequently.

Figure 2:
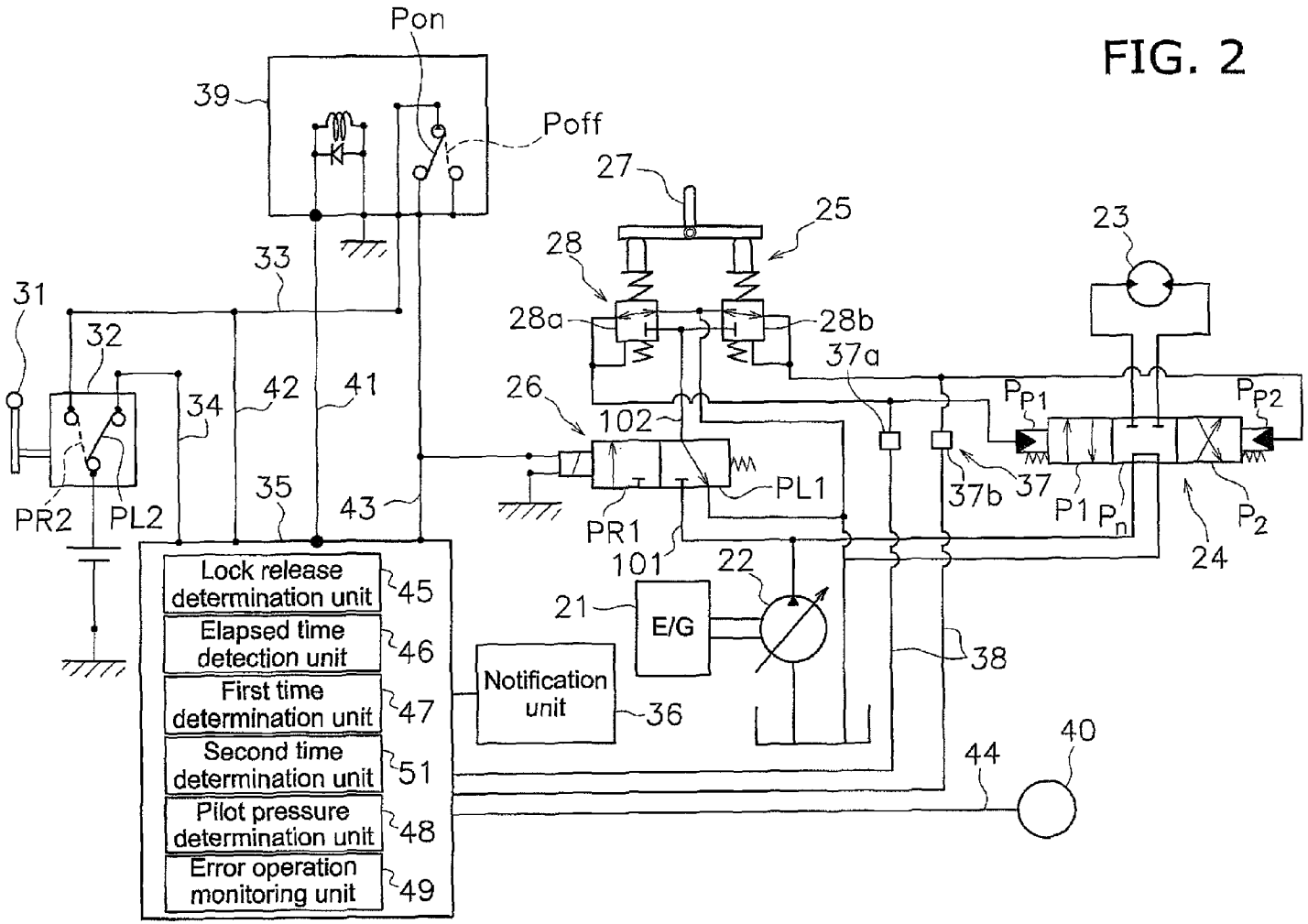
FIG. 2 is a schematic diagram showing the configuration of the operating system and the drive system of the working vehicle.

FIG. 2 is a schematic diagram showing the configuration of the operating system and the drive system installed in the working vehicle 100. As shown in FIG. 2 the working vehicle 100 is provided with an engine 21, a hydraulic pump 22 and a hydraulic actuator 23. The hydraulic pump 22 being driven by the engine 21, discharges hydraulic fluid. The hydraulic actuator 23 is driven by the hydraulic fluid discharged from the hydraulic pump 22. The hydraulic actuator 23 is, for example, a hydraulic motor that causes revolution of the revolving body 3.

The working vehicle 100 is provided with an actuator control valve 24, the operation device 25 and a lock valve 26. The actuator control valve 24 controls the hydraulic actuator 23 in conformance with input pilot pressure. Specifically, the actuator control valve 24 is a direction switching valve for switching the direction of supply of hydraulic fluid to the hydraulic actuator 23. The actuator control valve 24 switches between a first position condition P1, a second position condition P2, and a neutral position condition Pn. The actuator control valve 24 in the first position condition P1 supplies hydraulic fluid to the hydraulic actuator 23 such that the hydraulic actuator 23 drives in a first direction. The actuator control valve 24 in the second position condition P2 supplies hydraulic fluid to the hydraulic actuator 23 such that the hydraulic actuator 23 drives in a second direction. The second direction is the opposite direction to the first direction. The actuator control valve 24 in the neutral position condition Pn, shuts off supply of hydraulic fluid to the hydraulic actuator 23. In this way the hydraulic actuator 23 is stopped. The actuator control valve 24 has a first pilot port Pp1 and a second pilot port Pp2. By application of pilot pressure to the first pilot port Pp1, the actuator control valve 24 is set to the first position condition P1. By application of pilot pressure to the second pilot port Pp2, the actuator control valve 24 is set to the second position condition P2. When pilot pressure is not being applied to either of the first pilot port Pp1 or the second pilot port Pp2, the actuator control valve 24 is set to the neutral position condition Pn.

The operation device 25 is a device for operating the hydraulic actuator 23. The operation device 25 has an operating member 27 and a pilot valve 28. The operating member 27 is for example, an operating lever. The pilot valve 28 is supplied with hydraulic fluid from the hydraulic pump 22. The pilot valve 28 outputs pilot pressure in conformance with operation of the operating member 27. That is to say, the pilot valve 28 reduces the pilot pressure of hydraulic fluid from the hydraulic pump 22 in conformance with operation of the operating member 27. The pilot valve 28 has a first pilot valve 28*a* and a second pilot valve 28*b*. Pilot pressure discharged from the first pilot valve 28*a* (hereinafter referred to as "first pilot pressure"), is applied to the first pilot port Pp1 of the actuator control valve 24. Pilot pressure discharged from the second pilot valve 28*b* (hereinafter referred to as "second pilot pressure"), is applied to the second pilot port Pp2 of the actuator control valve 24. In this way, in conformance with operation of the operating member 27, the actuator control valve 24 is set to either of the first position condition P1, the second position condition P2, or the neutral position condition Pn.

The lock valve 26 is arranged along the oil path connecting the hydraulic pump 22 and the pilot valve 28. The lock valve 26 is an electromagnetic valve. The lock valve 26 switches between a release condition PR1 and a lock position PL1 in conformance with the absence or presence of input of a release signal. Specifically, the lock valve 26 holds the lock condition PL1 when there is no input of the release signal. The lock valve 26 switches from the lock condition PL1 to the release condition PR1 when there is input of the release signal. The lock valve 26 in the release condition PR1 connects an oil path 101 on the side having the hydraulic pump 22 and an oil path 102 on the side having pilot valve 28. In this way hydraulic fluid from the hydraulic pump 22 is supplied to the pilot valve 28. That is to say, the lock valve 26, in the release condition PR1, allows supply of pilot pressure to the actuator control valve 24. In this way, operation of the hydraulic actuator is allowed. The lock valve 26 in the lock condition PL1 shuts off the oil path 101 on the side having the hydraulic pump 22 and the oil path 102 on the side having the pilot valve 28. The lock valve 26 in the lock condition PL1 connects the oil path 102 on the side having the pilot valve 28 to a hydraulic fluid tank. In this way hydraulic fluid from the hydraulic pump 22 is not supplied to the pilot valve 28. That is to say, the lock valve 26 in the lock condition PL1 shuts off supply of pilot pressure to the actuator control valve 24. With the lock valve 26 in the lock condition PL1, regardless of operation of the operating member 27, the actuator control valve 24 is maintained in the neutral position condition Pn. Accordingly, with the lock valve 26 in the lock condition PL1, even if the operator operates the operating member 27, the hydraulic actuator 23 will not move. That is to say, the hydraulic actuator 23 is prohibited from moving.

As shown in FIG. 2, the working vehicle 100 is provided with a lock member 31, a lock switch 32, a first signal line 33, a second signal line 34, a controller 35, and a notification unit 36.

The lock member 31 is arranged inside the driver's cabin 4. The lock member 31 is capable of switching between a lock position and a release position. For example, the lock member 31 is arranged so as to project toward the inside of the driver's cabin 4 in the release position. The lock member 31 is arranged so as not to project toward the inside of the driver's cabin 4 in the lock position, or such that, in the lock position, the degree of projection toward the inside of the driver's cabin 4 is small. The lock switch 32 switches between a lock position PL2 and a release position PR2 linked to the operation of the lock member 31. When the lock member 31 is positioned in the lock position, the lock switch 32 positions in the lock position PL2. When the lock member 31 is positioned in the release position, the lock switch 32 positions in the release position PR2.

The first signal line 33 conveys a release signal from the lock switch 32 to the lock valve 26. When the lock switch 32 is set to the release position PR2, a release signal from the lock switch 32 is input to the lock valve 26 via the first signal line 33. In this way, the lock valve 26 is set to the release condition PR1. The second signal line 34 conveys a lock switch signal from the lock switch 32 to the controller 35. When the lock switch 32 is set to the lock position PL2, a lock switch signal from the lock switch 32 is input to the controller 35 via the second signal line 34. At this time, as a release signal from the lock switch 32 is not input to the lock valve 26, the lock valve 26 is set to the lock condition PL1.

The controller 35 includes memory such as RAM or ROM or the like, and a computation device such as a CPU or the like. The notification unit 36 is for example a monitor. When the controller 35 receives a lock switch signal via the second signal line 34, the controller 35 outputs a notification from the notification unit 36 to the operator. The notification to the operator is made by for example displaying a message or icon on the monitor.

Further, the working vehicle 100 is provided with a pilot pressure detection unit 37 and a third signal line 38. The pilot pressure detection unit 37 detects pilot pressure. The pilot pressure detection unit 37 has a plurality of pressure sensors. Specifically, the pilot pressure detection unit 37 has a first pressure sensor 37*a* and a second pressure sensor 37*b*. The first pressure sensor 37*a* detects the first pilot pressure. The second pressure sensor 37*b* detects the second pilot pressure. The third signal line 38 conveys a signal from the pilot pressure detection unit 37 to the controller 35. As described subsequently, the controller 35 makes a determination of an error operation at time of operation of the lock member 31 based on the pilot pressure as detected by the pilot pressure detection unit 37.

Further, the working vehicle 100 is provided with a relay 39, a fourth signal line 41, a fifth signal line 42, and a sixth signal line 43. The relay 39 is arranged along the first signal line 33. The fourth signal line 41 conveys a signal from the controller 35 to the relay 39. The relay 39 switches between an ON condition Pon and an OFF condition Poff in conformance with whether or not there is a signal from the controller 35. The relay 39 in the ON condition Pon connects the lock switch 32 and the lock valve 26. In this way a release signal can be conveyed from the lock switch 32 to the lock valve 26. The relay 39 in the OFF condition Poff blocks between the lock switch 32 and the lock valve 26. In this way it becomes impossible to convey a release signal from the lock switch 32 to the lock valve 26. The relay 39 is set to the ON condition Pon when a signal is input from the controller 35. The relay 39 is set to the OFF condition Poff when a signal is not input from the controller 35.

The fifth signal line 42 is connected to a position in the first signal line 33 between the lock switch 32 and the relay 39. Accordingly, a release signal from the lock switch 32 is conveyed to the controller 35 via the fifth signal line 42. The controller 35 detects whether or not the lock member 31 is set to the release position depending on whether or not a release signal is received via the fifth signal line 42. The sixth signal line 43 is connected a position between the relay 39 and the lock valve 26 in the first signal line 33. Accordingly, depending on whether or not a release signal is received via the sixth signal line 43, the controller 35 detects whether the relay 39 is in the ON condition Pon or the OFF condition Poff, and whether the lock valve 26 is in the lock condition PL1 or the release condition PR1.

Further, the working vehicle 100 is provided with a key switch 40 and a seventh signal line 44. The key switch 40 is switched between an ON condition and an OFF condition by a key for starting the working vehicle 100. The key switch 40 outputs a signal when in the ON condition. The seventh signal line 44 conveys a signal from key switch 40 to the controller 35.

Figure 3:
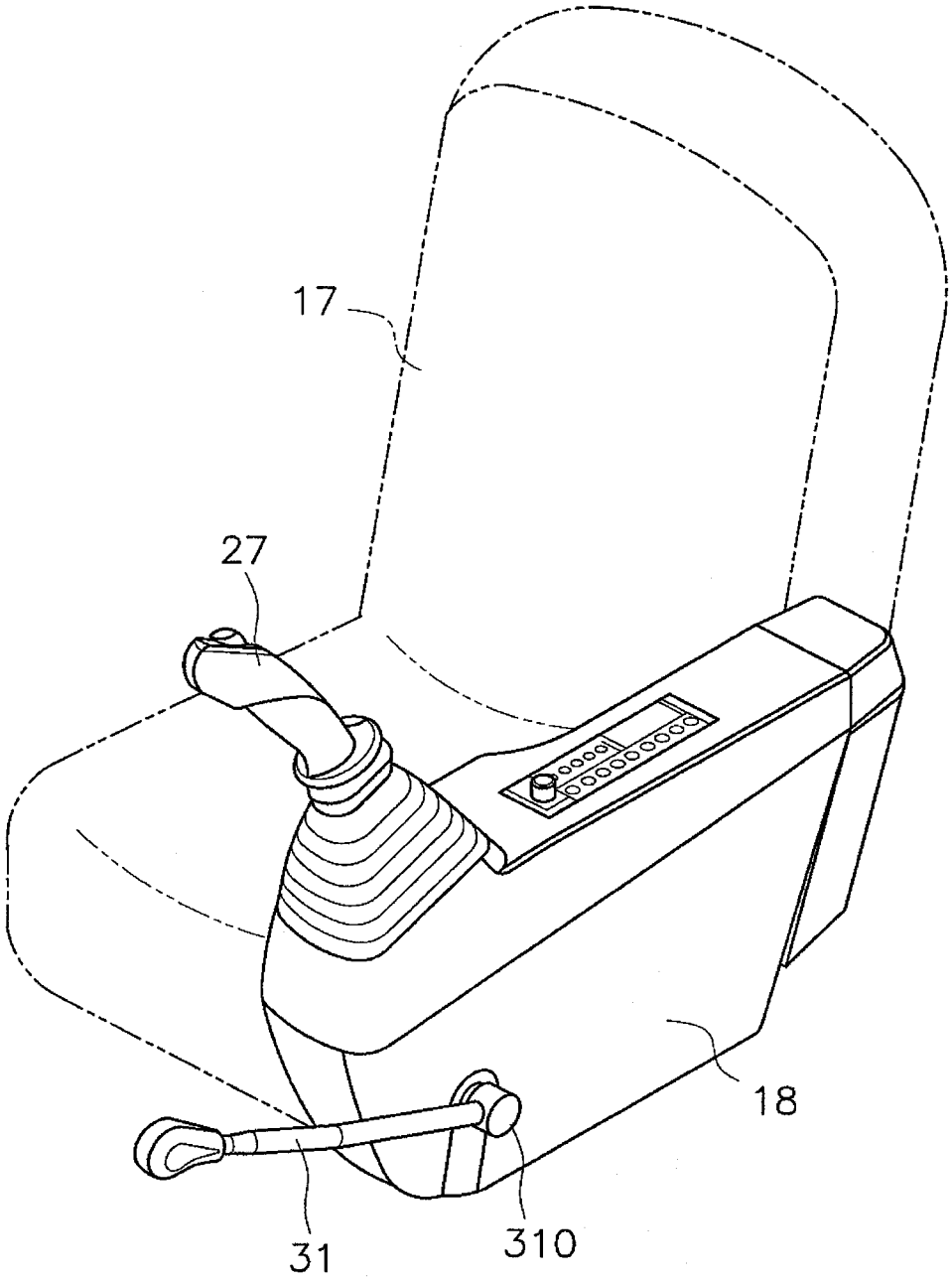
FIG. 3 is a perspective view showing inside the driver's cabin.

As shown in FIG. 3, inside the driver's cabin 4 are arranged a seat 17 and an operation console 18. The operation console 18 is arranged to the lateral side of the seat 17. The operation console 18 is arranged between the seat 17 and a door 40 of the driver's cabin 4 (refer FIG. 1). The operation console 18 supports the operating member 27 and the lock member 31. The operating member 27 is installed in the upper face of the operation console 18. Specifically, the operating member 27 is installed in the front part of the upper face of the operation console 18.

Figure 4:
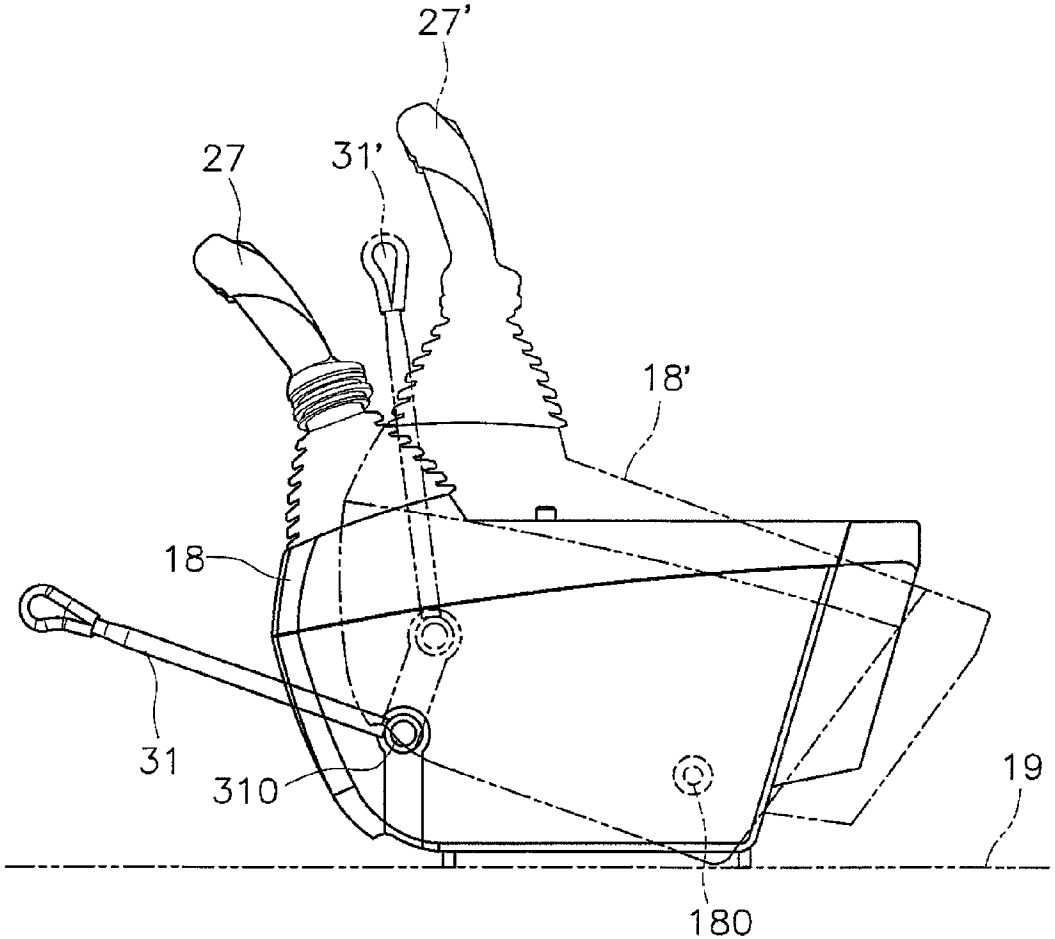
FIG. 4 is a side view of the operation console.

The lock member 31 is installed in the lateral side face of the operation console 18. Specifically, the lock member 31 is installed in the front part of the lateral side face of the operation console 18. The lock member 31 is installed so as to be able to turn in relation to the operation console 18. FIG. 4 is a side view of the operation console 18. As shown in FIG. 4, the lock member 31, by turning around the rotational axis 310 in relation to the operation console 18, switches between the release position (31 in FIG. 4) and the lock position (31' in FIG. 4). The release position (31) is positioned lower than the lock position (31').

The operation console 18 has a flip-up type mechanism and is arranged so as to be capable of pivoting upward or downward in relation to the floor surface 19 of the driver's cabin 4. The operation console 18 pivots around the pivoting axis 180. The operation console 18 moves together with the lock member 31. In the case in which the lock member 31 is positioned in the release position (31), the operation console 18 is positioned in the first position (18 in FIG. 4). In the first position (18), the operation console 18 is in the condition of being dropped down to the floor surface 19. That is to say, the front part of the bottom part of the operation console 18 is in contact with the floor surface 19. Further, with the operation console 18 in the first position (18), a part of the lock member 31 projects further forward than the front face of the operation console 18.

In the case in which the lock member 31 is in the lock position (31'), the operation console 18 is in the second position (18' in FIG. 4). In the second position (18'), the operation console 18 is in the condition of being flipped-up from the floor surface 19. That is to say, the front part of the operation console 18 that is in the second position (18') is positioned higher than the front part of the operation console 18 in the first position (18). The position (27' in FIG. 4) of the operating member 27 with the operation console 18 in the second position (18') is positioned higher than the position (27 in FIG. 4) of the operating member 27 with the operation console 18 in the first position (18). In the second position (18'), the front part of the bottom part of the operation console 18 is separated upward from the floor surface 19. Further, with the operation console 18 in the second position (18'), the lock member 31 is positioned further rearward than the front face of the operation console 18.

When the operator pulls up the lock member 31 from the release position (31) to the lock position (31'), as the operation console 18 pivots upward together with the lock member 31, the operation console 18 moves from the first position (18) to the second position (18'). In the opposite case, when the operator pushes down the lock member 31 from the lock position (31') to the release position (31), the operation console 18 pivoting downward together with the lock member 31 moves the operation console 18 from the second position (18') to the first position (18).

Figure 5:
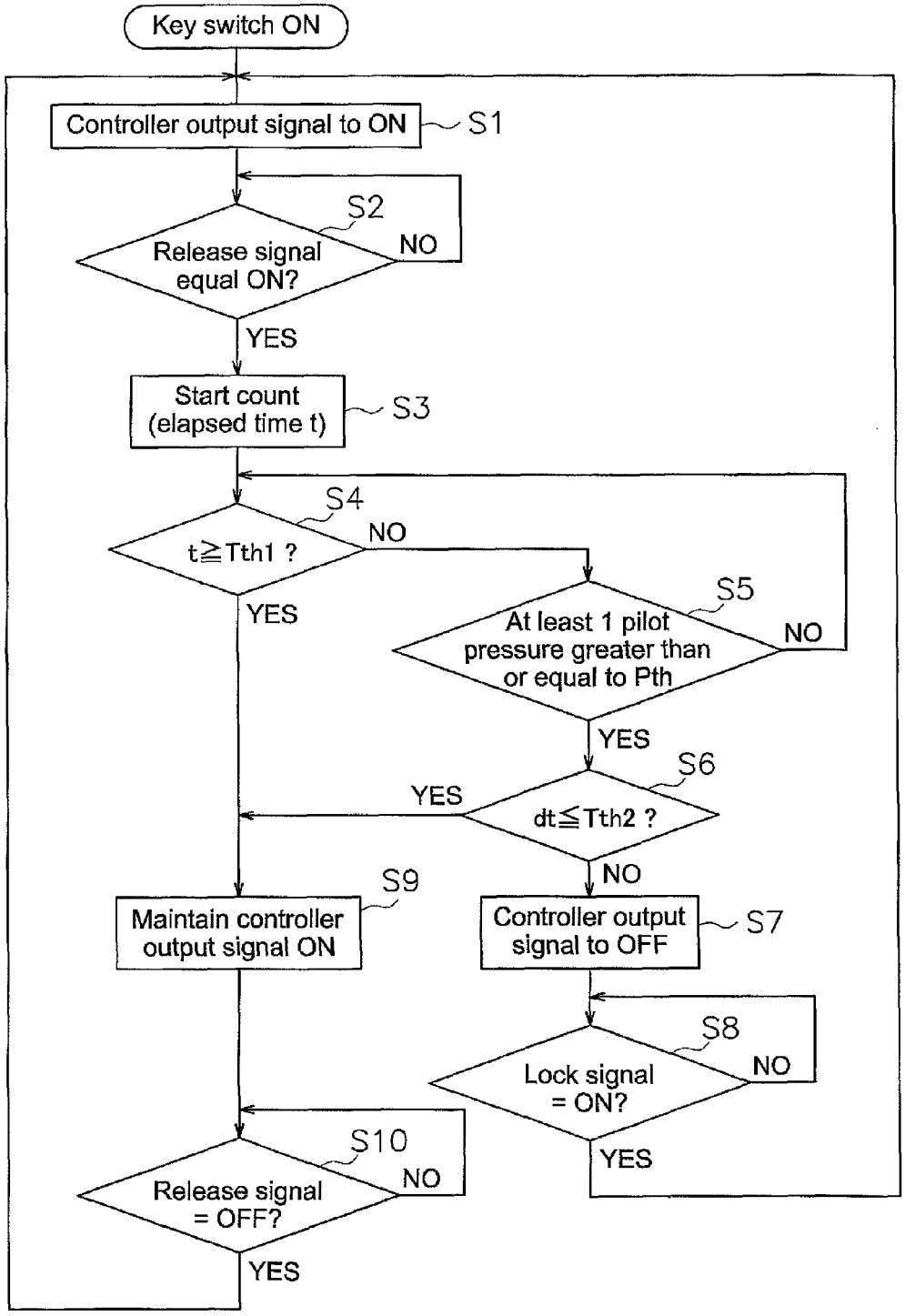
FIG. 5 is a flowchart showing the processes for determination of an error operation.
Figure 6:
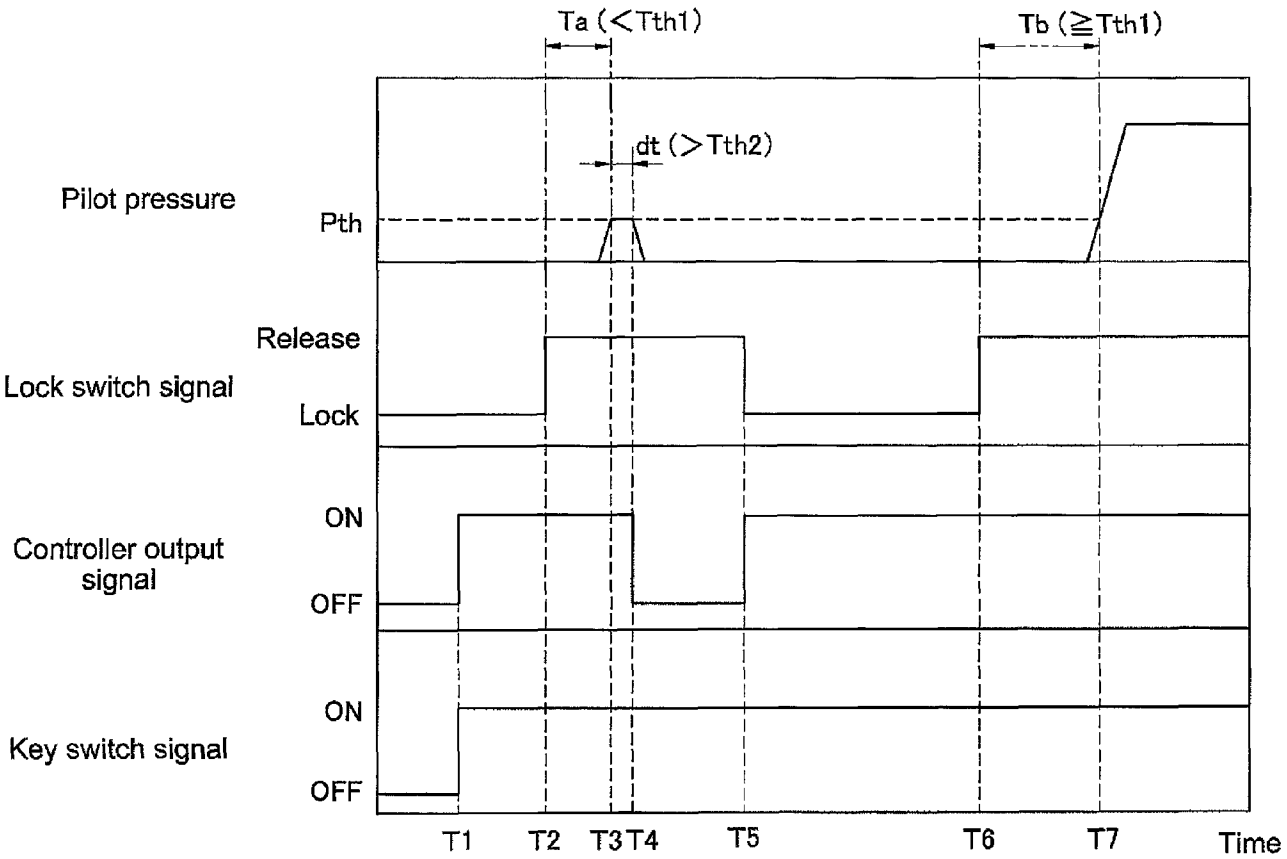
FIG. 6 is a timing chart showing the changes through different kinds of signals when making a determination of an error operation.
Figure 7:
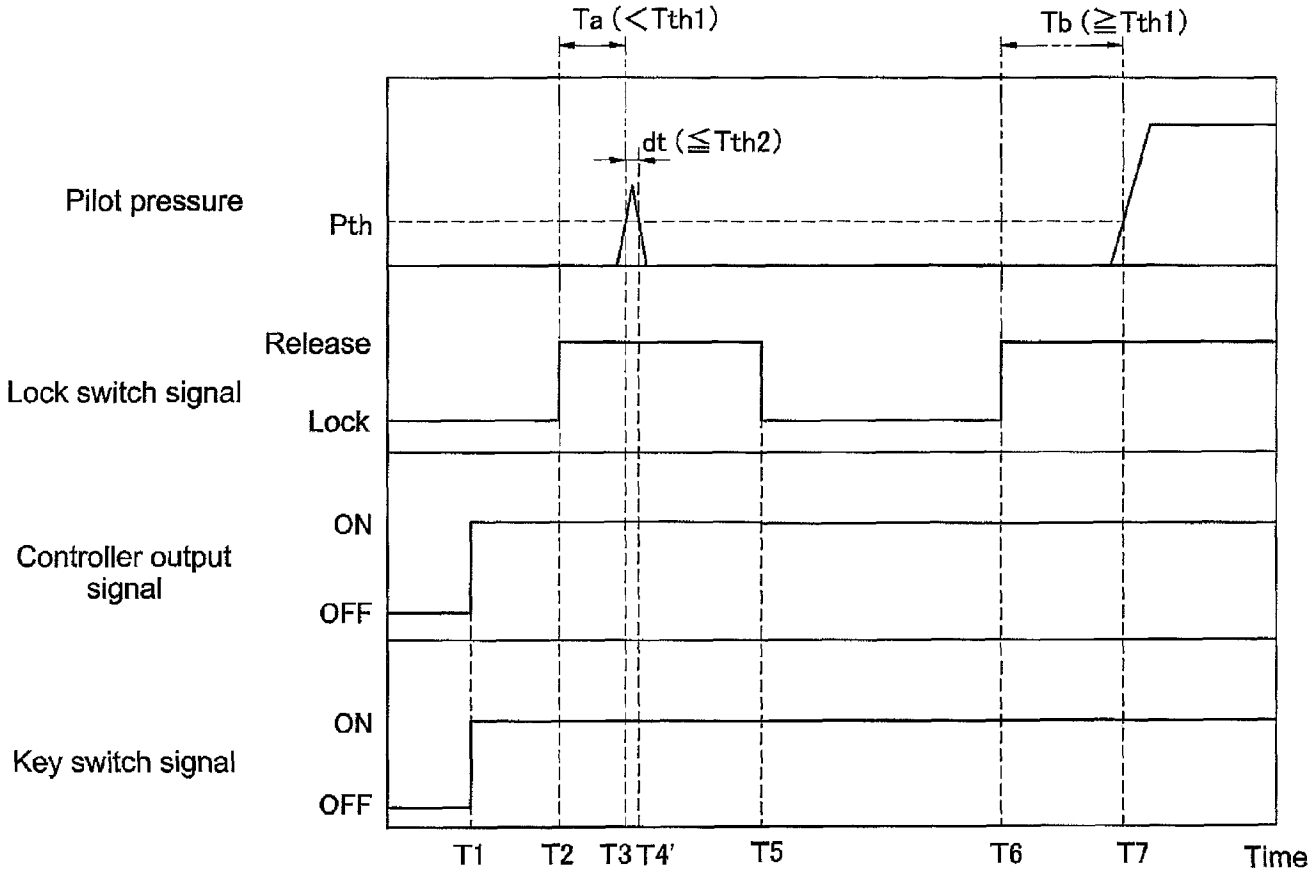
FIG. 7 is a timing chart showing the changes through different kinds of signals when making a determination of an error operation.

The processes performed by the controller 35 for determination of an error operation will now be described. As shown in FIG. 2, the controller 35 includes a lock release determination unit 45, an elapsed time detection unit 46, a first time determination unit 47, a second time determination unit 51, a pilot pressure determination unit 48, and an error operation monitoring unit 49. FIG. 5 is a flowchart showing the processes for determination of an error operation. FIG. 6 and FIG. 7 are timing charts showing the changes when determining an error operation through pilot pressure, lock switch signal, controller output signal, and key switch signal. A lock switch signal is a signal from the lock switch 32 detected by the controller 35. Specifically, a lock switch signal is either of a lock switch signal conveyed via the second signal line 34 or a release signal conveyed via the fifth signal line 42. A controller output signal is a signal output to the relay 39 from the controller 35. The controller output signal being ON means a signal is being output to the relay 39 from the controller 35. The controller output signal being OFF means the signal is not being output to the relay 39 from the controller 35. A key switch signal is a signal output to the controller 35 from the key switch 40. The key switch signal being ON means the signal is being output to the controller 35 from the key switch 40. The key switch signal being OFF means the signal is not being output to the controller 35 from the key switch 40. Note that pilot pressure shown in FIG. 6 and FIG. 7 is an illustrative example of one pilot pressure of a plurality detected by the pilot pressure detection unit 37.

As shown in FIG. 5, when the key switch 40 is in the ON condition, at step S1 the error operation monitoring unit 49 sets the controller output signal to ON (time T1 in FIG. 6). In this way the relay 39 is set to the ON condition Pon. In this case, the condition of the lock valve 26 becomes capable of switching in conformance with the position of the lock switch 32. That is to say, in conformance with the operation of the lock member 31, the hydraulic actuator 23 becomes capable of switching between lock and release.

At step S2, the lock release determination unit 45 determines whether or not the release signal is ON. When the release signal is being conveyed to the controller 35 via the fifth signal line 42, the lock release determination unit 45 determines that the release signal is ON. That is to say, the lock release determination unit 45 determines whether or not the lock member 31 is switched to the release position. When the release signal is ON (time T2 in FIG. 6), the process proceeds to step S3. When the release signal is ON moreover the relay 39 is in the ON condition Pon, the release signal is conveyed to the lock valve 26 via the first signal line 33. Accordingly, the lock valve 26 is set to the release condition PR1. In this way raising of pilot pressure commences in conformance with operation of the operating member 27.

At step S3, the elapsed time detection unit 46 commences counting elapsed time t. Elapsed time t is the elapsed time (elapsed time Ta in FIG. 6) from the point in time lock is released, that is to say from the point in time at which the lock member 31 is switched from the lock position to the release position (time T2 in FIG. 6).

At step S4, the first time determination unit 47 determines whether or not the elapsed time t is greater than or equal to the first predetermined time Tth1. The first predetermined time Tth1 means, in the condition in which the operating member 27 is set to the position for operating the hydraulic actuator 23, the time until the pilot pressure rises up to the predetermined pressure Pth when the lock member 31 is switched from the lock position to the release position. The first predetermined time Tth1 is obtained in advance by experimentation or through simulation, and is recorded in the controller 35. Preferably the first predetermined time is greater than or equal to 0.2 seconds and less than or equal to 2 seconds. When the elapsed time t is not greater than or equal to the first predetermined time Tth1, the process proceeds to step S5.

At step S5, the pilot pressure determination unit 48 determines whether or not at least one of a plurality of pilot pressures is greater than or equal to the predetermined pressure Pth. When at least one pilot pressure is not greater than or equal to the predetermined pressure Pth, the process proceeds to step S4. When at least one pilot pressure is greater than or equal to the predetermined pressure Pth (time T3 in FIG. 6), the process proceeds to step S6.

At step S6, the second time determination unit 51 determines whether or not the continuous time duration dt for which the pilot pressure is greater than or equal to the predetermined pressure Pth is less than or equal to a second predetermined time Tth2. When the continuous time duration dt is not less than or equal to the second predetermined time Tth2, the process proceeds to step S7. That is to say when the continuous time duration dt is greater than the second predetermined time Tth2, the process proceeds to step S7 (T4 in FIG. 6). Note that the second predetermined time Tth2 is obtained in advance by experimentation or through simulation, and is recorded in the controller 35. The second predetermined time Tth2 is less than the first predetermined time Tth1. Preferably the second predetermined time Tth2 is smaller than 0.2 seconds, and more preferably still, the second predetermined time Tth2 is greater than or equal to 0.05 seconds and less than 0.1 seconds.

At step S7, the controller output signal is turned OFF (time T4 in FIG. 6). Further, the elapsed time detection unit 46 resets the elapsed time t and the continuous time duration dt to 0. When the controller output signal is turned OF,F the relay 39 is set to the OFF condition Poff. That is to say, when the elapsed time t is less than the first predetermined time Tth1, moreover the continuous time duration dt is greater than the second predetermined time Tth2, the error operation monitoring unit 49 switches the lock valve 26 to the lock condition PL1 even though the lock switch 32 is in the release position PR2. For this reason, regardless of operation of the operating member 27, pilot pressure to the actuator control valve 24 does not rise, and falls after the controller output signal is turned OFF. Accordingly, even though the lock member 31 is in the release position, operation of the hydraulic actuator 23 is locked.

At step S8, the lock release determination unit 45 determines whether or not the lock switch signal is ON. The lock switch signal being ON means that the lock switch signal is being conveyed to the controller 35 via the second signal line 34. When the lock switch signal is not ON, the controller output signal is maintained at OFF. That is to say, in the case that at least one pilot pressure becomes greater than or equal to the predetermined pressure Pth moreover the continuous time duration dt becomes greater than the second predetermined time Tth2 when the elapsed time t is less than the first predetermined time Tth1, thereafter, the error operation monitoring unit 49 maintains the lock valve 26 in the lock condition PL1 as long as the lock member 31 does not return from the release position to the lock position. In this way, the shutoff of pilot pressure to the actuator control valve 24 is maintained. When the lock switch signal is ON (time T5 in FIG. 6), the process returns to step S1. That is to say, when the lock member 31 has returned from the release position to the lock position, the process returns to step S1.

As described above, at step S1 the controller output signal is turned ON (time T5 in FIG. 6). In this way switching of the hydraulic actuator 23 between lock and release becomes possible in conformance with operation of the lock member 31. Further, at step S2, the lock release determination unit 45 determines whether or not the release signal is ON. When the release signal is ON (time T6 in FIG. 6), the process proceeds to step S3. At step S3, the elapsed time detection unit 46 commences counting the elapsed time t. The elapsed time t is the elapsed time (elapsed time Tb in FIG. 6) from the point in time when the lock member 31 switches from the lock position to the release position (T6 in FIG. 6).

At step S4, when the elapsed time t is greater than or equal to the first predetermined time Tth1, the process proceeds to step S9. That is to say, when none of the pilot pressures has become greater than the predetermined pressure Pth until the elapsed time t reaches the first predetermined time Tth1, the process proceeds to step S9.

At step S9, the error operation monitoring unit 49 maintains the controller output signal at ON (time T7 onward in FIG. 6). That is to say, the error operation monitoring unit 49 maintains the relay 39 in the ON condition Pon. In this way, while the lock member 31 is set to the release position, the lock valve 26 is maintained in the release condition PR1. For this reason, the pilot pressure increases in conformance with operation of the operating member 27. Further, the elapsed time detection unit 46 resets the elapsed time t to 0.

At step S10, the lock release determination unit 45 determines whether or not the release signal is OFF. The release signal being OFF means that the release signal is not being conveyed to the controller 35 via the fifth signal line 42. When the release signal is OFF, the process returns to step S1. That is to say, when the lock member 31 has switched from the release position to the lock position, the process returns to step S1.

At step S6 described above, when the continuous time duration dt is less than or equal to the second predetermined time Tth2, the process proceeds to step S9 (T4' in FIG. 7). At step S9 the error operation monitoring unit 49 maintains the controller output signal at ON. That is to say, the error operation monitoring unit 49 maintains the relay 39 in the ON condition Pon. In this way, while the lock member 31 is set to the release position, the lock valve 26 is maintained in the release condition PR1. Further, the elapsed time detection unit 46 resets the elapsed time t and the continuous time duration dt to 0.

In the working vehicle 100 related to this embodiment of the present invention, when the lock member 31 switches from the lock position to the release position, in response to a release signal from the lock switch 32, the lock valve 26 switches from the lock condition PL1 to the release condition PR1. However, in the case that the pilot pressure is greater than or equal to the predetermined pressure Pth moreover the continuous time duration dt is greater than the second predetermined time Tth2 when the elapsed time t is less than the first predetermined time Tth1, the error operation monitoring unit 49 returns the lock valve 26 to the lock condition PL1 even though the lock member 31 is set to the release position. In this way the fact of a rapid rising up of pilot pressure means that the lock member 31 has switched to the release position in the condition in which the operating member 27 is set to the actuator drive position. In this way it can be accurately determined whether or not the operating member 27 is set in the actuator drive position when the lock member 31 has switched to the release position.

However, even though the pilot pressure is greater than or equal to the predetermined pressure when the elapsed time t is less than the first predetermined time Tth1, the error operation monitoring unit 49 maintains the lock valve 26 in the release condition in the case that the continuous time duration dt is less than or equal to the second predetermined time Tth2. Accordingly, in the case that the increase in pilot pressure is nothing more than momentary, this is not seen as an error operation and the lock valve 26 is maintained in the release condition. For this reason, even though pilot pressure rises due to a temporary movement of the operating member 27 caused by shock when the operation console 18 is pushed down, an erroneous detection that the operating member 27 is set in the actuator drive position is prevented. In this way, it can be accurately detected that the operating member 27 is not set in the actuator drive position when the lock member 31 is switched to the release position.

Further, in the case that the pilot pressure is greater than or equal to the predetermined pressure Pth when the elapsed time t is greater than or equal to the first predetermined time Tth1, the error operation monitoring unit 49 maintains the lock valve 26 in the release condition PR1. In this way the pilot pressure slowly rising means that the lock member 31 has switched to the release position in the condition in which the operating member 27 is not set in the actuator drive position. In this way, it can be accurately determined that the operating member 27 is not set in the actuator drive position when the lock member 31 switches to the release condition.

The lock valve 26 is arranged along the oil path connecting the hydraulic pump 22 and the pilot valve 28. For this reason, pilot pressure output is able to be shut off to a plurality of oil paths with the single lock valve 26.

When the elapsed time t corresponding to at least one pilot pressure from among the plurality of pilot pressures is less than the first predetermined time Tth1, moreover the continuous time duration dt is greater than the second predetermined time Tth2, the error operation monitoring unit 49 shuts off supply of pilot pressure to the actuator control valve 24. Thus, when the lock member 31 switches to the release position, erroneous operation of the hydraulic actuator 23 can be more accurately suppressed.

The present invention has been described above with reference to an embodiment thereof, however the present invention is not limited to the above described embodiment, and various variations and modifications may be possible without departing from the scope of the present invention.

In the above-described embodiment a hydraulic shovel provided an illustrative example of the working vehicle, however the present invention can be suitably applied to other kinds of working vehicle such as a wheel loader or a bulldozer or the like.

In the above-described embodiment, a hydraulic motor used for revolving a revolving body provided an illustrative example of the hydraulic actuator, however it is also suitable to use another kind of hydraulic actuator. For example, it is also suitable to use the travel hydraulic motor (not shown in the drawings), the boom cylinder 10, the arm cylinder 11, or the bucket cylinder 12. Alternatively it is also suitable to use a combination of some of these, or a combination of all of these. That is to say, the plurality of pilot pressures used in step S5 as described above, are not limited to a hydraulic motor for revolving the revolving body, and also suitable are the pilot pressures to the actuator control valve for controlling the travel hydraulic motor (not shown in the drawing), the boom cylinder 10, the arm cylinder 11, or the bucket cylinder 12 or the like.

It is suitable for the notification unit 36 to output a notification to the operator when the error operation monitoring unit 49 shuts off supply of pilot pressure to the actuator control valve 24. In this way, when the lock member 31 has switched to the release position the fact that the operating member 27 has been operated erroneously can be recognized by the operator by a notification from the notification unit 36. In the above-described embodiment a monitor provided an illustrative example of the notification unit 36, however it is also suitable to use another device such as a lamp or a buzzer or the like.

The lock member 31 and the operating member 27 are not restricted to being levers, and it is suitable for these members to be provided as switches, buttons or pedals or the like. Operation of the operation console 18 is not restricted to pivoting in the vertical direction, and it is suitable for example for the operation console 18 to move in the forward backward direction. The configurations of the operation console 18, the lock member 31 and the operating member 27 are not restricted to those as described above. For example, it is suitable for the position in which the lock member 31 or the operating member 27 is installed in relation to the operation console 18 to be changed.

Figure 8:
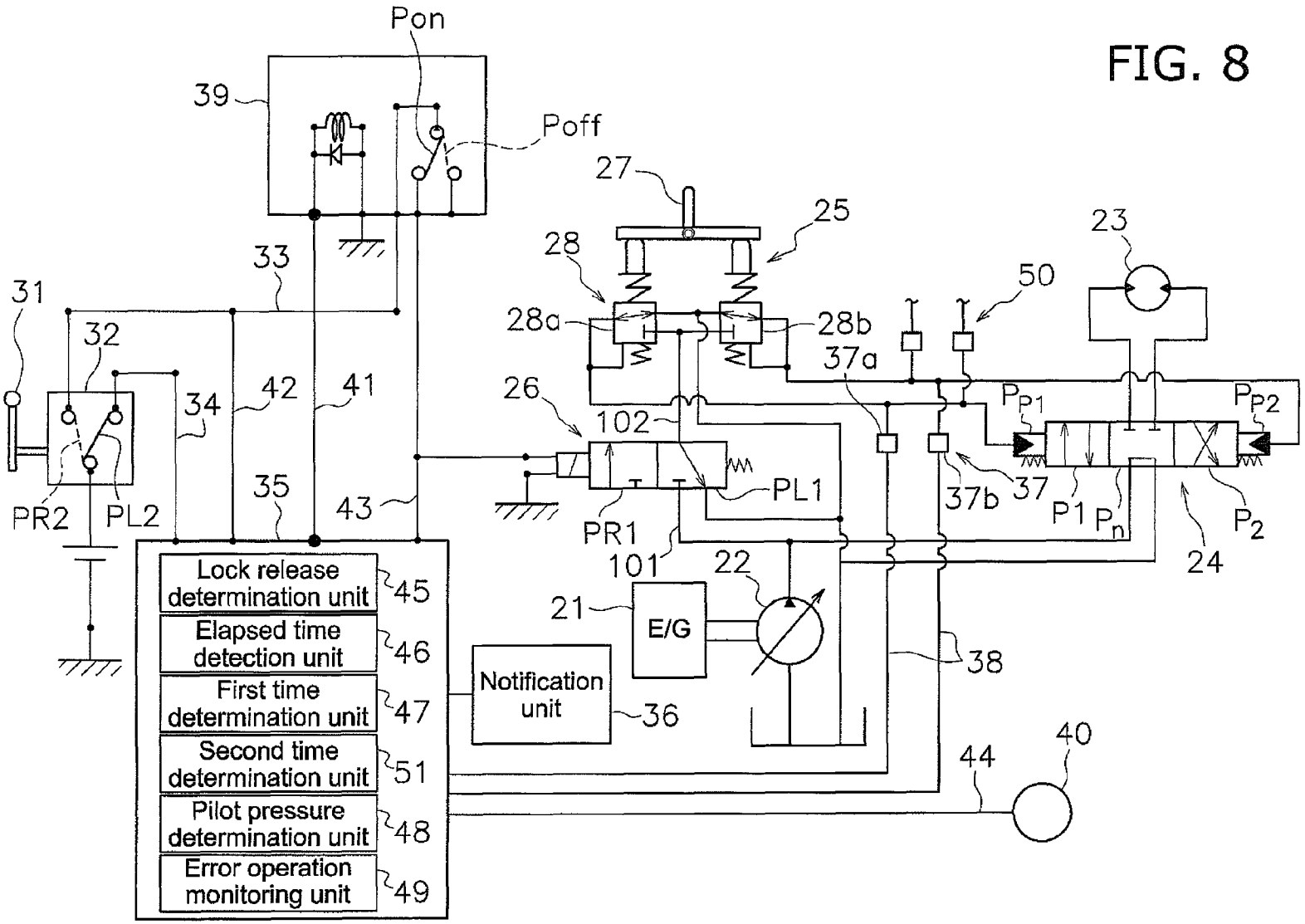
FIG. 8 is a schematic diagram showing the operating system and the drive system according to another embodiment.

As shown in FIG. 8, it is suitable for the working vehicle 100 to be further provided with a temperature detection unit 50 for detecting the temperature of hydraulic fluid. In this case, the first time determination unit 47 causes the first predetermined time Tth1 to increase to the extent that there is a decrease in the temperature of the hydraulic fluid. In this way, a still more accurate determination can be made of whether or not the operating member 27 is set in the actuator drive position when the lock member 31 has switched to the release position.

FIELD OF INDUSTRIAL APPLICATION

The present invention provides a working vehicle and a method for controlling a working vehicle that are capable of accurately determining whether or not the operating member is operated to be in the actuator drive position when the lock member is switched to the release position.

The invention claimed is:

1. A working vehicle:

a hydraulic actuator;

an operating member configured to operate the hydraulic actuator;

a pilot valve configured to output pilot pressure in conformance with operation of the operating member;

an actuator control valve configured to control the hydraulic actuator in conformance with the pilot pressure input thereto;

a lock member configured to be switched between a lock position and a release position;

an operation console configured to move together with the lock member, the operation console supporting the operating member and the lock member;

a lock valve configured to be switched between a release condition in which a supply of pilot pressure to the actuator control valve is allowed, and a lock condition in which supply of pilot pressure to the actuator control valve is shut off;

a lock valve switching unit configured to switch the lock valve from the lock condition to the release condition when the lock member switches from the lock position to the release position;

an elapsed time detection unit configured to detect an elapsed time from when the lock member switched from the lock position to the release position;

a first time determination unit configured to determine whether or not the elapsed time is greater than or equal to a first predetermined time;

a pilot pressure determination unit configured to determine whether or not the pilot pressure is greater than or equal to a predetermined pressure;

a second time determination unit configured to determine whether or not a continuous time duration during which the pilot pressure is greater than or equal to the predetermined pressure is less than or equal to a second predetermined time; and an error operation monitoring unit configured to allow switching over of the lock valve by the lock valve switching unit, in a case that the pilot pressure becomes greater than or equal to the predetermined pressure when the elapsed time is greater than or equal to the first predetermined time, the error operation monitoring unit being configured to switch the lock valve to the lock condition in a case that the pilot pressure becomes greater than or equal to the predetermined pressure and the continuous time duration is greater than the second predetermined time when the elapsed time is less than the first predetermined time, and the error operation monitoring unit being configured to allow switching over of the lock valve by the lock valve switching unit in a case that the pilot pressure becomes greater than or equal to the predetermined pressure and the continuous time duration is less than or equal to the second predetermined time when the elapsed time is less than the first predetermined time.

2. The working vehicle according to claim 1, wherein the first predetermined pressure is greater than or equal to 0.2 seconds and less than or equal to 2 seconds.

3. The working vehicle according to claim 1, wherein the second predetermined time is less than the first predetermined time.

4. The working vehicle according to claim 3, wherein the second predetermined time is less than 0.2 seconds.

5. The working vehicle according to claim 1, further comprising a hydraulic pump configured to supply hydraulic fluid to the pilot valve, the lock valve being positioned along an oil path connecting the hydraulic pump and the pilot valve.

6. The working vehicle according to claim 1, further comprising:

a controller including the elapsed time detection unit, the first time determination unit, the second time determination unit, and the error operation monitoring unit;

a pilot pressure detection unit configured to detect pilot pressure;

a first signal line configured to convey a signal from the lock valve switching unit to the lock valve;

a second signal line configured to convey a signal from the lock valve switching unit to the controller;

a third signal line configured to convey a signal from the pilot pressure detection unit to the controller;

a relay arranged along the first signal line; and a fourth signal line configured to convey a signal from the controller to the relay.

7. The working vehicle according to claim 1, wherein the pilot pressure is set as a first pilot pressure, the pilot valve outputs a plurality of pilot pressures including the first pilot pressure and a second pilot pressure, the second pilot pressure being output from an oil path different from an oil path from which the first pilot pressure is output, and the error operation monitoring unit switches the lock valve to the lock condition in a case that at least one of the pilot pressures is greater than or equal to the predetermined pressure and the continuous time duration is greater than the second predetermined time when the elapsed time is less than the first predetermined time.

8. The working vehicle according to claim 1, further comprising a notification unit configured to output a notification to an operator when the error operation monitoring unit switches the lock valve to the lock condition.

9. The working vehicle according to claim 1, further comprising a temperature detection unit configured to detect a temperature of the hydraulic fluid, the first time determination unit increasing the first predetermined time as the temperature of the hydraulic fluid decreases.

10. The working vehicle according to claim 1, wherein the operation console is arranged to pivot upward and downward, and the operation console is configured to pivot from higher toward lower together with the lock member switching from the lock position to the release position.

11. The working vehicle according to claim 1, wherein the working vehicle is a hydraulic shovel having a revolving body, and the hydraulic actuator is any one of a revolving motor configured to revolve the revolving body, a travel hydraulic motor, a boom cylinder, an arm cylinder, and a bucket cylinder.

12. A control method for controlling a working vehicle having a hydraulic actuator, an operating member configured to operate the hydraulic actuator, a pilot valve configured to output pilot pressure in conformance with operation of the operating member, an actuator control valve configured to control the hydraulic actuator in conformance with the pilot pressure output from the pilot valve, a lock member configured to be switched between a lock position and a release position, an operation console configured to move together with the lock member, the operation console supporting the operating member and the lock member, and a lock valve configured to be switched between a release condition in which supply of pilot pressure to the actuator control valve is allowed, and a lock condition in which supply of pilot pressure to the actuator control valve is shut off, the control method comprising:

switching the lock valve from the lock condition to the release condition when the lock member switches from the lock position to the release position;

detecting an elapsed time from when the lock member switches from the lock position to the release position until the pilot pressure rises to a predetermined pressure;

determining whether or not the elapsed time is greater than or equal to a first predetermined time;

determining whether or not a continuous time duration during which the pilot pressure is greater than or equal to the predetermined pressure is less than or equal to a second predetermined time;

maintaining the lock valve in the release condition when the elapsed time is greater than or equal to the first predetermined time;

switching the lock valve to the lock condition when the elapsed time is less than the first predetermined time, and the continuous time duration is greater than the second predetermined time; and maintaining the lock valve in the release condition when the elapsed time is less than the first predetermined time, and the continuous time duration is less than or equal to the second predetermined time.

13. A control method for controlling a working vehicle, comprising:

switching a lock valve from a lock condition prohibiting operation of a hydraulic actuator to a release condition allowing operation of the hydraulic actuator when a lock member is switched from a lock position to a release position together with an operation console supporting the lock member and a operating member configured to operate the hydraulic actuator;

switching the lock valve to the lock condition in a case that pilot pressure in conformance with operation of the operating member rises up to a predetermined pressure within a first predetermined time from a point in time at which the lock member switches from the lock position to the release position, and the pilot pressure is maintained greater than or equal to the predetermined pressure for a time longer than a second predetermined time; and maintaining the lock valve in the release condition in a case that the pilot pressure rises up to the predetermined pressure within the first predetermined time from the point in time at which the lock member switches from the lock position to the release position, and a continuous time duration for which the pilot pressure is maintained greater than or equal to the predetermined pressure is less than or equal to the second predetermined time.

* * * * *